United States Patent [19]
Denaro et al.
[11] 4,450,544
[45] May 22, 1984

[54] ABSORPTIVE SONAR BAFFLE

[75] Inventors: Alfred Denaro, Commack; George Rand, Franklin Square, both of N.Y.

[73] Assignee: Sperry Corporation, New York, N.Y.

[21] Appl. No.: 321,851

[22] Filed: Nov. 16, 1981

[51] Int. Cl.³ ..... H04R 17/00

[52] U.S. Cl. ..... 367/176; 367/153; 367/167; 181/151; 181/264

[58] Field of Search ..... 367/141, 149, 152, 153, 367/155, 157, 162, 163, 166, 167, 171, 172, 174, 176, 178, 156; 181/146, 151, 272, 275, 0.5, 113, 264; 310/326, 327

[56] References Cited

U.S. PATENT DOCUMENTS

| | | | |
|---|---|---|---|
| 2,545,101 | 3/1951 | Meunier | 367/166 X |
| 2,571,899 | 10/1951 | Kroft et al. | 367/166 X |
| 3,185,868 | 5/1965 | Coyle et al. | 367/162 X |
| 3,263,208 | 7/1966 | Douglois et al. | 367/167 X |
| 3,539,980 | 10/1970 | Massa | 367/167 X |
| 3,781,779 | 12/1973 | Tallman | 367/174 X |
| 3,907,062 | 9/1975 | Brigham et al. | 367/153 |
| 4,140,992 | 2/1979 | Wardle | 367/153 |

*Primary Examiner*—Harold J. Tudor
*Assistant Examiner*—Tyrone Davis
*Attorney, Agent, or Firm*—Howard P. Terry

[57] ABSTRACT

The acoustical energy absorbing baffle has a pair of restricted orifice screens rigidly secured in parallel, spaced relation by a lattice stiffener. The screen-stiffener assembly is immersed in a viscous fluid contained within a tank sealed with an elastic diaphragm. Incident acoustical energy is transmitted through the diaphragm and translated into energy absorbing motion of the fluid through the restrictive screens. A compliant mass is acoustically coupled to the fluid to augment fluid particle velocity through the screens and to further absorb energy.

12 Claims, 8 Drawing Figures

ABSORPTIVE SONAR BAFFLE

BACKGROUND OF THE INVENTION

1. Field of the Invention

This invention relates generally to sonar equipment and in particular to an acoustical energy absorbing baffle for minimizing sound reflection, and providing isolation from noise producing sources.

2. Description of the Prior Art

In the sonar art the desire for improved detection ranges and localization accuracy has brought about an increase in the size of sonar arrays. This, in turn, has raised the need for improved ways of mitigating the effect of background noise, such as the ambient noise of the sea, and the ship's own self noise. Ambient sea noise arises principally from the wave motion of the sea, from marine creatures, and from the radiated noise of ocean shipping. Ambient noise is usually considered to be isotropic, that is, non-directional. Self noise is caused by the flow of water over the hydrophones and by specific machinery noise generated by the ship on which the hydrophones are carried. Self noise is usually anisotropic or directional in nature. Both types can mask an incoming signal and thus present a problem to sonar system performance.

Acoustic baffles are often used with sonar arrays to provide discrimination against noise sources in certain directions as well as to alter the shape of the array's directivity pattern. The baffle can thus shield the sonar array from the ship's own self noise, as well as reduce the level of ambient noise by making the array more directive. Many baffle designs have been tried, although none have been wholly successful.

For instance, it is known that certain cellular, air trapping, sponge materials, if placed between the hydrophone and the ship, will produce an acoustical impedance mismatch which can reflect ship generated noise. But incident sonar signal energy is likewise reflected. Since air has a lower acoustical impedance than water, these reflections will be out of phase with the incident sonar waves and will add destructively to cancel the incident signal. One prior art solution to this cancellation problem is to place a steel signal conditioning plate between the sponge material and the hydrophone. Since steel has a higher impedance than water, and if sufficiently thick in respect to wavelength, signal energy is reflected in phase with incident energy adding constructively. At present day sonar wavelengths, the steel plate must be at least on the order of three-fourth inches thick in order to be acoustically visible. Thus weight is a significant problem. Another problem attendant to the reflective baffle is that, being designed to reflect acoustical energy, the baffle actually increases the vessel's visibility to other sonar detectors. This is particularly undesirable in submarine applications, where visibility should ideally be reduced, not increased.

Another prior art approach has been the attempt to absorb rather than reflect noise energy. With an absorptive baffle the object is to match the baffle's impedance to the medium's impedance, so noise energy will propagate freely into the baffle without reflection. Once inside the baffle ideally all noise energy is trapped and dissipated. However, as is known, perfect impedance matching is difficult to achieve over a broad band of frequencies and a wide range of hydrostatic pressures. For many baffle materials the response characteristics change dramatically with depth of submersion. For instance, neoprene rubber composites becomes less and less absorptive as it compresses under the increasing pressures of greater and greater oceanic depths. Furthermore, vibrational modes can exist within the baffle which introduce frequency dependent anomolies or non-linearities in the array response. These vibrational modes or resonances cause some energy to be reradiated instead of dissipated.

Aside from their utility in connection with isolating sonar arrays from the effects of background noise, acoustical baffles are receiving increased attention for their utility as an anechoic hull coating for submarines and other vessels. Again, weight is a prime consideration, and the anechoic coating should provide relatively constant echo reduction over a wide range of frequencies and independent of the depth of submersion. Prior art techniques have far from met these requirements.

The present invention overcomes these difficulties and achieves a practical, light weight, pressure tolerant absorptive baffle that can be used with a sonar array. In addition, the invention also provides an anechoic baffle which may be placed on a vessel's hull surface to render the vessel less visible to sonar detection.

SUMMARY OF THE INVENTION

The acoustical energy absorbing baffle of the invention comprises a fluid containment chamber having rigid sidewalls and end walls including at least one elastic membrane or diaphragm. Disposed within the chamber are a pair of parallel screens each having a plurality of restricted orifices and a viscous fluid. The parallel screens are rigidly secured in spaced relation to one another by means of a lattice stiffner, which has a plurality of fluid passages within the lattice network and communicating with the restricted orifices of the screen. A second compartment or containment chamber is disposed on one end of the first chamber adjacent one of the screens and houses a compliant resilient pressure absorbing material therein. The pressure absorbing material, comprising a foam core disposed between two parallel rigid plates, is positioned to achieve good acoustical coupling to the fluid within the containment chamber. The foam core and plates are encapsulated in molded polyurethane to resist the effects of prolonged immersion in sea water.

DESCRIPTION OF THE PREFERRED EMBODIMENT

Figure 1:
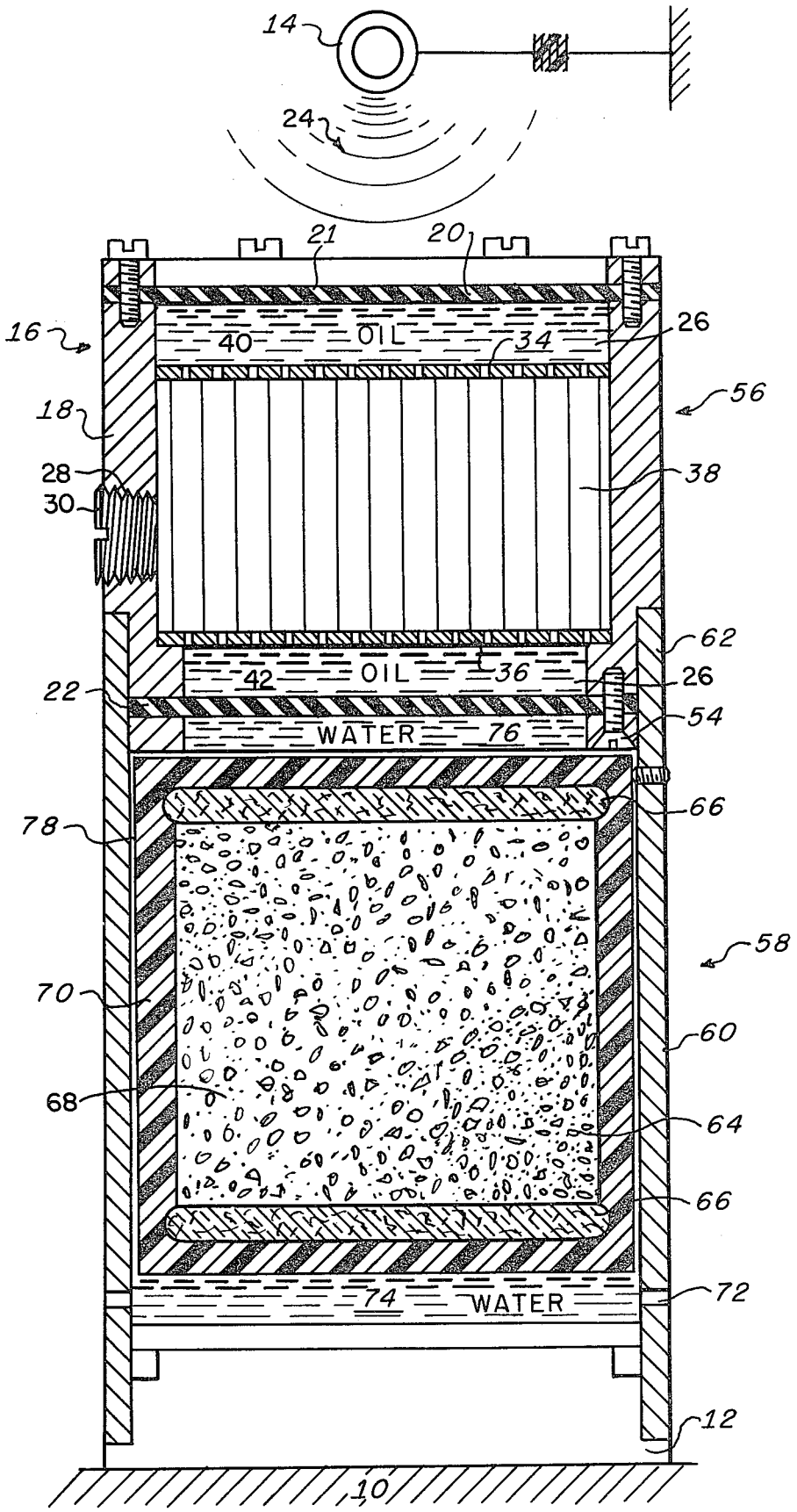
FIG. 1 is a cross-sectional view of the invention.
Figure 2:
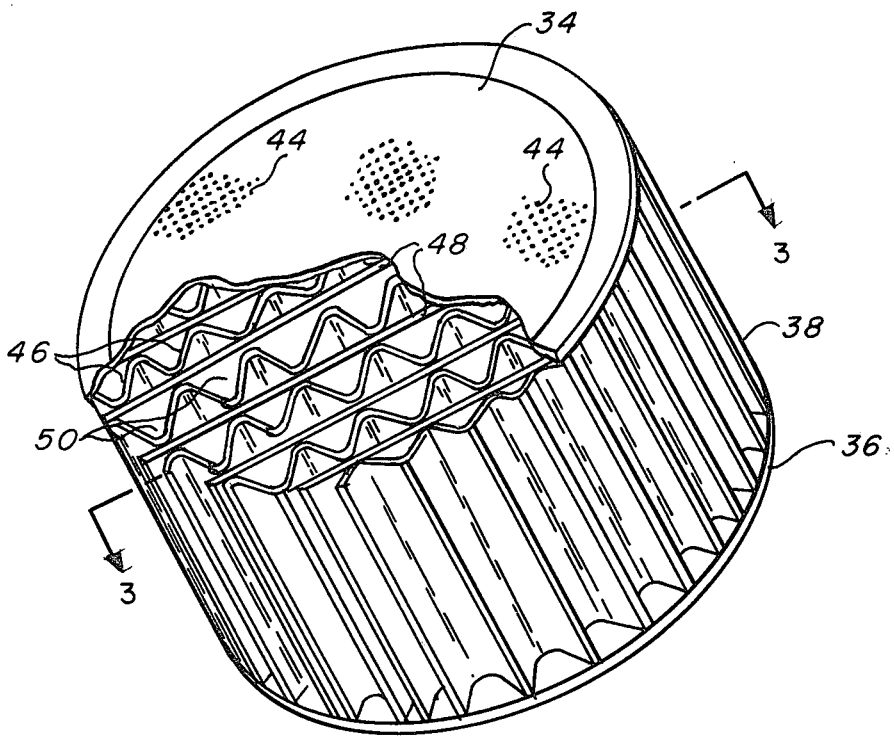
FIG. 2 is a perspective view of a resistive screen and lattice stiffening component of the invention.
Figure 3:
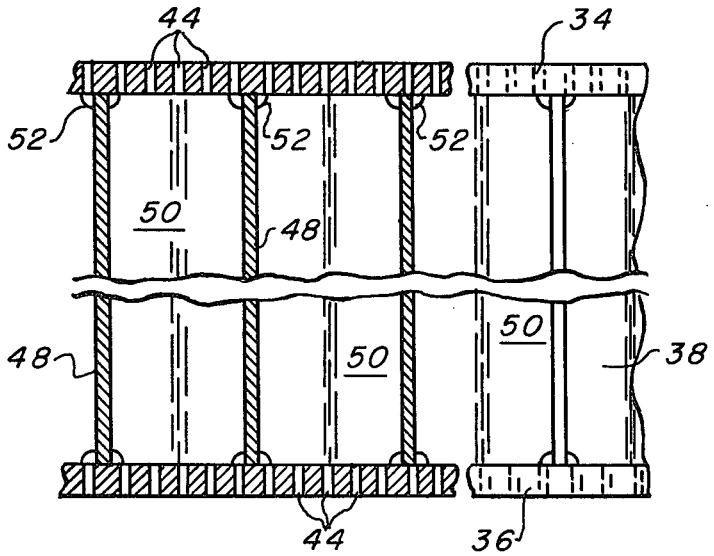
FIG. 3 is a detailed sectional view of the resistive screen and lattice stiffener taken along the line 3—3 of FIG. 2.

FIG. 1 shows an embodiment of the acoustic absorbing baffle which will demonstrate the principles of the invention. The presently preferred embodiment is shown in FIGS. 4–8. The baffle may be used in conjunction with a hydrophone 14 which might be vibration isolated from the hull of the ship, as shown diagrammatically, or which might be encapsulated or embedded within the baffle. The invention comprises a fluid containment tank 16 having rigid sidewalls 18. First and second elastic membranes or diaphragms 20 and 22 are disposed on each end of the fluid containment tank forming end walls. The first diaphragm 20 is arranged, in use, so that acoustical energy carried by the medium 24 will impinge upon its outwardly facing surface 21. The medium 24 may be any medium capable of transmitting acoustical energy, including fluid media such as water. To minimize reflections at the medium 24 and diaphragm 20 interface, the diaphragm should comprise a material having an acoustical impedance as similar as possible to the impedance of the medium. For instance, a rubber diaphragm may be used to match the acoustical impedance of a water media. Within the fluid containment tank 16 is a viscous fluid 26. To facilitate introducing the viscous fluid into the tank, the tank sidewalls 18 are provided with an inlet orifice 28 which may be sealed with threaded plug 30. First and second rigid plates or screens 34 and 36 are secured, as by brazing, to a lattice stiffener 38, and the combined stiffener and screen component is rigidly secured within the fluid containment tank 16, to define a first fluid region 40 between first screen 34 and first diaphragm 20, and to define a second fluid region 42 between second screen 36 and second diaphragm 22. It will be understood that the first and second fluid regions 40 and 42 contain the viscous fluid 26. The screen stiffener assembly is shown in more detail in FIGS. 2 and 3. The screens 34 and 36 have a plurality of small pores or fluid restrictive orifices 44. The stiffener 38, in the presently preferred embodiment, comprises a lattice work structure, a corrugated system or network of small intersecting diagonal or zig zag members 46 that rigidly connect parallel members 48 to define a plurality of parallel fluid passages 50 which are arranged to communicate with the restricted orifices of screens 34 and 36. While the lattice stiffener is presently preferred, it will be appreciated that other stiffener constructions, such as honeycomb construction, for example, may be employed. It is desirable that the screens be supported against flexural or vibrational movement and therefore the screen should be secured to the stiffener at a multiplicity of points 52 as by bonding or brazing. It will be appreciated that this bonding or brazing has the effect of blocking some of the restricted orifices which degrades the porosity of the screen stiffener assembly. The brazing technique employed minimizes the hole blockage. Thus, there is some trade-off between screen rigidity and porosity, however, by making the orifices 44 sufficiently small with respect to the fluid passages 50, vibrational modes in a typical frequency range of interest may be kept to a minimum without seriously degrading porosity. It will be seen that the containment tank 16 together with diaphragms 20 and 22, which may be joined in a tight fluid seal by means of bolts or screws 54, comprise a sealed unit containing the screen stiffener assembly and viscous fluid 26. As will be more fully explained, this sealed unit comprises a first energy absorbing baffle 56 or acoustical impedance matching section.

Acoustically coupled to the first energy absorbing baffle 56 is a second baffle 58. A second baffle comprises a second containment tank 60 having sidewalls 62 which are adapted to register with the sidewalls 18 of the first energy absorbing baffle 56. The second containment tank houses a compliant resilient assembly or mass 64 which comprises a pair of rigid spaced apart plates, preferably of a lightweight material such as fiberglass reinforced plastic. The rigid plates 66 are arranged generally parallel to the second screen 36 of the first energy absorbing baffle. A foam core 68 is disposed between the plate 66 and the entire compliant mass is encapsulated in a flexible jacket 70. Between the second diaphragm 22 and the compliant assembly 64 is a second fluid chamber 76 for coupling acoustical energy between the second diaphragm and the compliant mass. This chamber 76 may be filled with a fluid such as the viscous fluid used in the first containment tank, or it may be filled by the fluid of the energy transmissive medium as shown in FIG. 1. When the structure is used in conjunction with a hydrophone, the baffle is placed between the ship's hull and the hydrophone, in close proximity to the hydrophone. In this regard, those skilled in the art will appreciate that the separation between the hydrophone and the baffle usually represents an insignificant fraction of a wavelength, thus acoustically the hydrophone and baffle are virtually coincident. Or, as stated earlier, the hydrophone which may be piezoceramic, fiberoptic, polymer, or other types, may be molded or encapsulated in the first diaphragm 20.

Figure 4B:
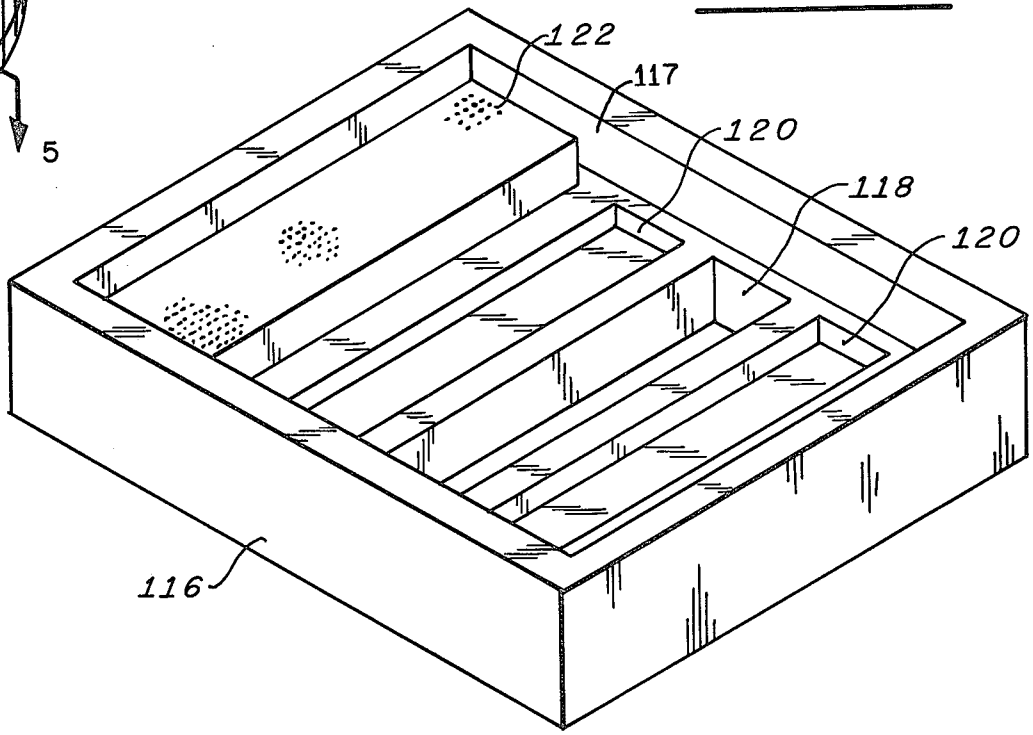
FIG. 4 is a partially assembled perspective view of an alternative embodiment of the invention.
Figure 4A:
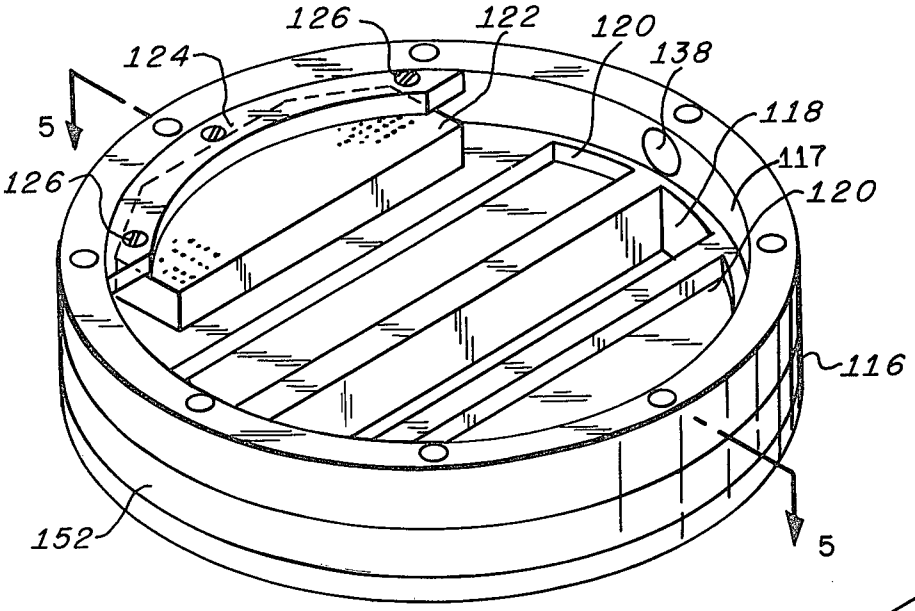
Figure 5:
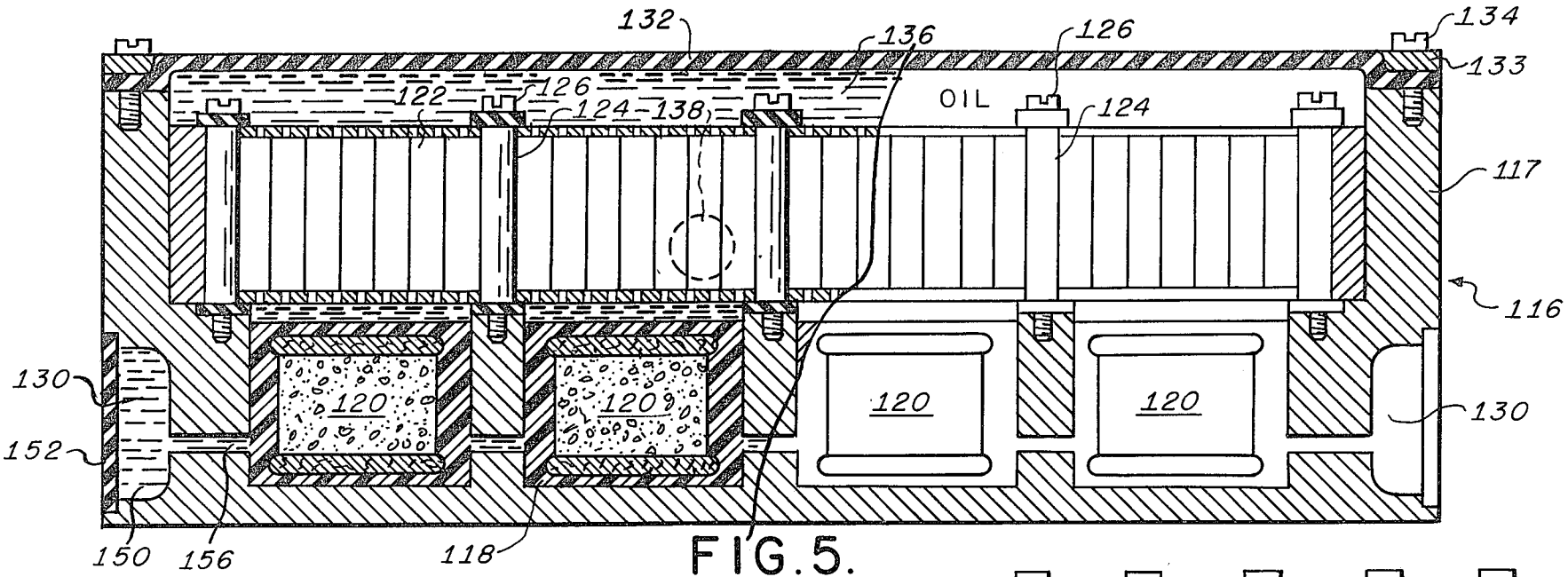
FIG. 5 is a vertical sectional view of the alternative embodiment taken along the line 5—5 of FIG. 4.
Figure 6:
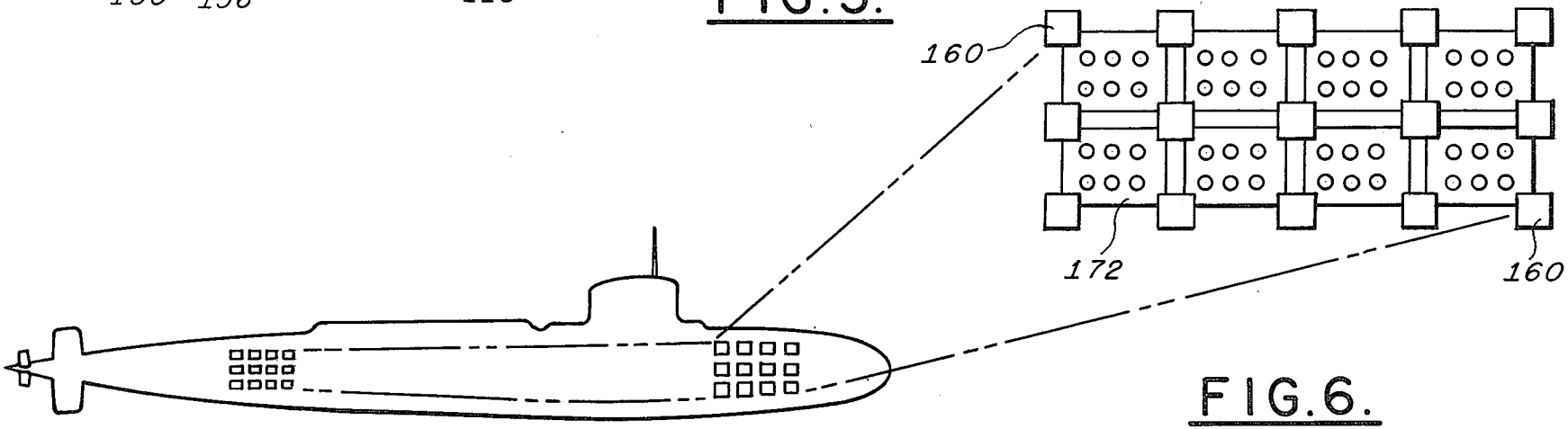
FIG. 6 is a perspective view illustrating an arrangement of acoustic baffles forming an anechoic hull coating.

In applications where the invention is used as a hull covering to minimize a vessel's sonar detectability, a thinner, more streamline baffle is desirable. FIGS. 4, 5 and 6 illustrate how this may be achieved. In this second, presently preferred embodiment the baffle comprises a fluid containment tank 116 having sidewalls 117 and a plurality of reservoirs or wells 118 into each of which a compliant mass 120 is disposed. The sidewalls 117 may define a cylindrical or rectangular baffle as shown in FIGS. 4A and 4B. Secured above each well is a screen stiffener baffle assembly 122 which may be secured by means of bracket 124 and screws 126. Defined within the wells 118 between each compliant assembly 120 and screen-stiffener assembly 122 is a second fluid region 130. An elastic membrane or diaphragm 132 is secured to the sidewalls 117 of the fluid containment tank 116 by means of a retaining ring 133 and screws 134. The elastic diaphragm and screen-stiffener assembly 122 define therebetween a first fluid region 136. The first and second fluid regions, as well as the screen-stiffener assembly 122 are filled with a viscous fluid by means of an inlet orifice 138. It will be noted that in this alternate embodiment the viscous fluid is in direct contact with the compliant mass and a second diaphragm is not required.

The preferred embodiment further includes a pressure compensation system comprising a well 150 around the outer periphery of sidewalls 117 covered by a pressure compensation diaphragm 152. The well 150 and diaphragm 152 define a compensation fluid reservoir 154 which is filled with a fluid such as the viscous fluid used in the first containment tank. A fluid conduit 156 communicates between the reservoir 154 and wells 118 which contain each compliant mass assembly 120. In this way static pressures such as oceanic hydrostatic pressure, are communicated to the compliant assemblies 120 to equalize the pressure within the baffle.

A multiplicity of these reduced thickness baffles may be assembled on the exterior hull of a vessel, as shown in FIG. 6. Preferably these baffles are of the rectangular cross-section and are held in place at the four corners as with bolts 160. If desired, the spaces between the baffles may be filled flush with a waterproof compound to provide a smoother surface for reduced drag.

Figure 7:
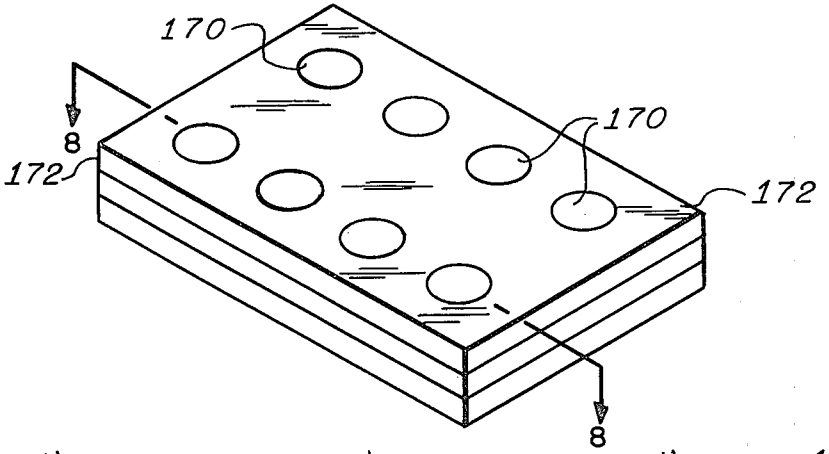
FIG. 7 is a perspective view showing a hydrophone array embedded in the outer diaphragm.
Figure 8:
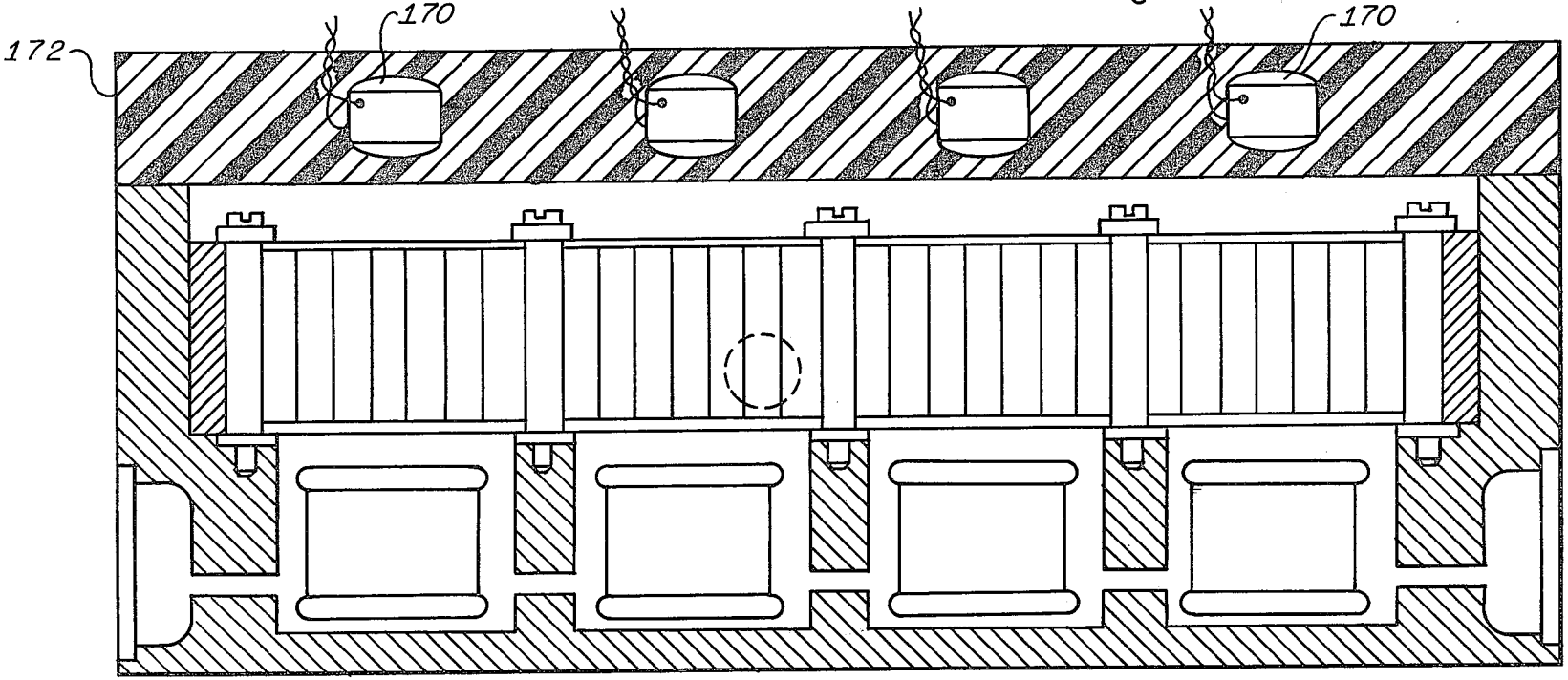
FIG. 8 is a vertical sectional view taken along the line 8—8 of FIG. 7.

As mentioned above the baffle may be placed behind the hydrophone or hydrophone array, or the hydrophone or array can be encapsulated within the diaphragm. Such an arrangement is shown in FIG. 7 wherein a hydrophone array, comprising a plurality of transducers 170, is embedded in the outer diaphragm 172.

OPERATION

A comparison of the first and second embodiments of FIGS. 1 and 5 respectively reveals that both baffles utilize an elastic diaphragm exposed to the transmissive medium to receive incident acoustical energy. When an acoustical wave impinges upon the elastic diaphragm, the viscous fluid contained within the first fluid region is compressed and forced through the restricted orifices 44 of the first screen member. Being forced through small holes, the viscous fluid frictionally gives up energy in the form of heat which is then dissipated in the baffle and surrounding medium. The flow into the fluid passage 50 increases the pressure within that passage causing a quantity of fluid to escape through the restricted orifices of the second screen member. This motion causes additional frictional heating with further removal of energy. Thus, the acoustical energy, having propagated through two fluid-saturated porous screens, is now considerably attenuated. What energy remains is acoustically coupled to the compliant mass for even greater attenuation. Should any of this energy be reflected from the compliant mass, it must propogate back through the restrictive screen thus suffering additional attenuation. The construction of the acoustical mass is such that the rigid plates 66 distribute the incident acoustical energy evenly across the volume of the foam core 68 and the encapsulating jacket 70 serves to protect the foam core from deterioration from sea water exposure, for instance. This construction produces the further benefit of assuring that the compliant mass will remain compliant even under great hydrostatic pressures. Aside from absorbing acoustical energy, the compliant mass also sets up a favorable boundary condition with respect to the viscous fluid such that a high fluid particle velocity is attained. Those skilled in the art will appreciate that a high particle velocity maximizes frictional losses and energy dissipation. It will be recalled that the ideal acoustical baffle is one that is purely resistive without reactance and is matched to the impedance of the medium to eliminate reflections. In this regard, the lattice stiffener attached to the first and second screen members at a multiplicity of points significantly limits flexural and vibrational modes of the screen members. Furthermore, the corrugated construction of the lattice resists lateral as well as end-to-end compression. Thus, the stiffener is also resistant to oscillation.

Thus, it will be seen that the present invention provides a practical, lightweight, pressure tolerant absorptive baffle which can be matched closely to the impedance of a transmissive medium such as water and serves to trap and dissipate incident acoustical energy through a system of fluid-saturated porous screens acting in concert with a pressure tolerant compliant or resilient mass. The invention is thus useful as an absorptive baffle for sonar arrays or as an anechoic hull coating.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. A baffle for absorbing acoustical energy comprising:

fluid containment means having a sidewall and opposed end walls for defining therein a first fluid chamber, one of said end walls comprising a first elastic diaphragm, viscous fluid contained within said first fluid chamber, first screen member disposed within said first fluid chamber defining a first fluid region between said first screen and said first elastic diaphragm, said first screen member having a plurality of restricted orifices therethrough which communicate with said first fluid region, second screen member disposed within said first fluid chamber having a plurality of restricted orifices therethrough, channel means positioned between said first and second screen members having a plurality of fluid passages for controlling flow of said viscous fluid between said orifices of said first and second screen members.

2. The baffle according to claim 1 wherein said fluid containment means defines a second fluid region adjacent said second screen member opposite said stiffening means which communicates with said orifices of said second screen member.

3. The baffle according to claim 1 further comprising second containment means acoustically coupled to said viscous fluid and disposed adjacent said second screen member, for containing therein compliant material.

4. The baffle according to claim 3 wherein said second containment means comprises a plurality of rigid, spaced apart plates arranged generally parallel to said second screen member, a foam core disposed between said plate, and flexible covering encapsulating said plate and said core.

5. The baffle according to claim 1 wherein said channel means includes a lattice positioned between said first and second screen members comprising a plurality of corrugated members separated by a plurality of planar members.

6. A baffle according to claim 3 which further includes pressure compensation means responsive to external static pressures for communicating said static pressure to said compliant means.

7. The baffle according to claim 6 wherein said pressure compensating means further comprises a fluid reservoir, a diaphragm enclosing said fluid reservoir, pressure compensating fluid within said fluid reservoir, conduit means for communicating fluid between said fluid reservoir and outer wall of said second containment means.

8. The baffle according to claim 1 wherein the other of said end walls includes a resilient means.

9. The baffle according to claim 3 wherein the other of said end walls comprises a second elastic diaphragm defining a third fluid region between said second diaphragm and said second containment means.

10. The baffle according to claim 3 which further comprises a plurality of said second containment means disposed on said fluid containment means, and acoustically coupled therebetween with said viscous fluid.

11. The baffle according to claim 1 further comprising at least one hydrophone encapsulated in said first elastic diaphragm.

12. A baffle according to claim 9 which further comprises a plurality of said first fluid containment means disposed upon a plurality of second containment means and acoustically coupled therebetween with said viscous fluid.

* * * * *